US006169869B1

(12) United States Patent
Inami et al.

(10) Patent No.: US 6,169,869 B1
(45) Date of Patent: Jan. 2, 2001

(54) IMAGE FORMING APPARATUS AND PROCESS CARTRIDGE

(75) Inventors: Satoru Inami; Junichi Kato; Masahiro Yoshida, all of Kashiwa; Yusuke Nakazono, Toride; Seiichi Shinohara, Abiko, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/492,335

(22) Filed: Jan. 27, 2000

(30) Foreign Application Priority Data

Jan. 28, 1999 (JP) ..... 11-019244

(51) Int. Cl.[7] ..... G03G 15/22

(52) U.S. Cl. ..... 399/159; 399/284; 399/285; 430/96; 430/102; 430/110; 430/111

(58) Field of Search ..... 399/159, 284, 399/285; 430/96, 110, 111, 102

(56) References Cited

U.S. PATENT DOCUMENTS

| | | | | |
|---|---|---|---|---|
| 5,382,489 | * | 1/1995 | Ojima et al. | 430/96 |
| 5,475,471 | | 12/1995 | Kisu et al. | 399/115 |
| 5,543,899 | | 8/1996 | Inami et al. | 399/176 |
| 5,585,212 | * | 12/1996 | Ueda | 430/96 |
| 5,589,313 | * | 12/1996 | Takezawa et al. | 430/111 |
| 5,688,622 | * | 11/1997 | Ito et al. | 430/111 |
| 5,765,077 | | 6/1998 | Sakurai et al. | 399/176 |
| 5,790,927 | | 8/1998 | Ando et al. | 399/176 |
| 6,001,523 | * | 12/1999 | Kemmesat et al. | 430/96 |

FOREIGN PATENT DOCUMENTS

| | | | |
|---|---|---|---|
| 1-206348 | * | 8/1989 | (JP) . |
| 4-78984 | * | 3/1992 | (JP) . |

* cited by examiner

*Primary Examiner*—Roland Martin
(74) *Attorney, Agent, or Firm*—Fitzpatrick, Cella, Harper & Scinto

(57) ABSTRACT

An image forming apparatus includes an image bearing member, a developer carrying member for carrying thereon a developer to transport the developer to a developing zone, and a regulation member provided in touch with the surface of the developer carrying member to regulate coat weight of the developer carried thereon. The image bearing member includes a conductive substrate and a photosensitive layer formed thereon, and the photosensitive layer contains at least one polycarbonate resin (I) having a viscosity-average molecular weight not more than $1.5\times10^4$ and at least one polycarbonate resin (II) having a viscosity-average molecular weight more than $1.5\times10^4$, the polycarbonate resin (I) being contained in a proportion of from 30% by weight to 95% by weight based on the total weight of the polycarbonate resins (I) and (II). On the developer carrying member, the developer is in a coat weight not more than 1.5 mg/cm$^2$ at the developing zone after its regulation by the regulation member. This apparatus can prevent smeared images and enables stable and high-grade image formation.

13 Claims, 4 Drawing Sheets

IMAGE FORMING APPARATUS AND PROCESS CARTRIDGE

BACKGROUND OF THE INVENTION

1. Field of the Invention

This invention relates to an image forming apparatus and a process cartridge which are used in copying machines, page printers, facsimile units and so forth.

2. Related Background Art

Powdery developers as exemplified by toners are used in image forming apparatus of electrophotographic systems, such as laser beam printers and copying machines.

Toner is kept in a developing container, and is transported onto a toner carrying member (developer carrying member) by a toner transporting means and held on the toner carrying member. Then, the toner is provided with prescribed electric charges by means of a toner-layer-thickness regulation member (e.g., a doctor blade), and is moved to the electrostatic-latent-image forming zone of an image bearing member for bearing electrostatic latent images, where an electrostatic latent image formed on the image bearing member (photosensitive member) is rendered visible. Thereafter, the visible image thus formed is transferred to a transfer material, such as paper, by a transfer means, and then fixed by means of a fixing assembly. Toner remaining on the image bearing member without being transferred to the transfer material is taken off from the surface of the image bearing member by means of a cleaning assembly and sent to a cleaning container. Thus, one image forming process is completed, and users can obtain a desired image.

Now, as one of developing methods, jumping development is known, in which the electrostatic latent image formed on the image bearing member is developed while keeping the developer carrying member of an image forming apparatus in non-contact with the image bearing member. An example of an image forming apparatus employing such jumping development will be described on an image forming apparatus shown in FIG. 1.

In the image forming apparatus shown in FIG. 1, a toner 8 kept in a developing container 3 is carried on a developer carrying member, e.g., a developing sleeve 10. As the developing sleeve 10 is rotated in the direction of an arrow b shown in the drawing, the toner 8 carried thereon is transported to the developing zone facing a photosensitive member 1 serving as the image bearing member. In the course where the toner 8 is transported there, it is regulated by a doctor blade 9 kept in touch with the developing sleeve 10, and is coated on the developing sleeve 10 in a thin layer. At the developing zone, the developing sleeve 10 and the photosensitive member 1 face each other, leaving a gap of from 50 to 500 $\mu$m between them. A development bias, formed by superimposing an alternating current on a direct current, is applied to the developing sleeve 10 from a bias power source 12 to cause the toner 8 coated on the developing sleeve 10 in a thin layer to fly and adhere to an electrostatic latent image formed on the photosensitive member 1, thus the electrostatic latent image is rendered visible as a toner image.

There is a problem of smeared images when images are formed in an environment of high temperature and high humidity. The term "smeared image" refers to the phenomenon that a low-resistance substance adheres to the surface of a photosensitive drum, where electric charges at the part charged electrostatically on the image bearing member photosensitive drum run into latent image areas to spoil images. This smeared image may be caused by moisture condensation on the photosensitive drum surface. In many cases, however, it is caused by talc contained in transfer materials or by surface-active agents contained in OHT (overhead thin film), having adhered to the photosensitive drum surface.

The talc, which is often contained in commonly available transfer materials, reacts with ozone generated from a charging assembly, and an oxide thus formed combines with moisture ascribable to high humidity, so that a low-resistance-substance ozone product is formed on the image bearing member to cause smeared images.

Thus, the problem of smeared images tends to depend on transfer materials. In conventional a image forming apparatus, it has been difficult to solve the problem of smeared images while achieving formation of images with a high resolution and a high minuteness and achieving running stability.

It is proposed to make the photosensitive drum surface abradable with ease so that good images can be formed over a long period of time (Japanese Patent Application Laid-open Nos. 4-78984 and 1-206348). However, the problem of how to prevent smeared images can not well be solved only by designing materials for photosensitive drums.

SUMMARY OF THE INVENTION

Accordingly, an object of the present invention is to provide an image forming apparatus that can can avoid the difficulties of smeared images and can form stable and high-grade images.

Another object of the present invention is to provide an image forming apparatus that can avoid the difficulties, such as smeared images and the slip-through of external additives, while improving image density and can form stable and high-grade images.

Still another object of the present invention is to provide a process cartridge that can avoid difficulties, such as smeared images and the slip-through of external additives, can form stable and high-grade images, and also can be maintenance-free.

The above objects can be achieved by the image forming apparatus and process cartridge according to the present invention.

More specifically, the present invention provides an image forming apparatus comprising an image bearing member, a developer carrying member for carrying thereon a developer to transport the developer to a developing zone, and a regulation member provided in touch with the surface of the developer carrying member to regulate the coat weight of the developer carried thereon; the developer carrying member carrying and transporting the developer to the developing zone, and an electrostatic latent image formed on the image bearing member being developed and rendered visible while applying a development bias to the developer carrying member, wherein the image bearing member comprises a conductive substrate and a photosensitive layer formed thereon, and the photosensitive layer contains at least one polycarbonate resin (I) having a viscosity-average molecular weight not more than $1.5\times10^4$ and at least one polycarbonate resin (II) having a viscosity-average molecular weight more than $1.5\times10^4$; the polycarbonate resin (I) being contained in a proportion of from 30% by weight to 95% by weight based on the total weight of the polycarbonate resins (I) and (II); and on the developer carrying member, the developer being in a coat weight not more than 1.5 mg/cm$^2$ at the developing zone after its regulation by the regulation member.

The present invention also provides a process cartridge comprising an image bearing member, a developer carrying member for carrying thereon a developer to transport the developer to a developing zone, and a regulation member provided in touch with the surface of the developer carrying member to regulate the coat weight of the developer carried thereon; the developer carrying member carrying and transporting the developer to the developing zone, and a means for developing and rendering visible an electrostatic latent image on the image bearing member while applying a development bias to the developer carrying member being set as one unit together with the above members so as to be detachably mountable to the main body of an image forming apparatus, wherein the image bearing member comprises a conductive substrate and a photosensitive layer formed thereon, and the photosensitive layer contains at least one polycarbonate resin (I) having a viscosity-average molecular weight not more than $1.5\times10^4$ and at least one polycarbonate resin (II) having a viscosity-average molecular weight more than $1.5\times10^4$; the polycarbonate resin (I) being contained in a proportion of from 30% by weight to 95% by weight based on the total weight of the polycarbonate resins (I) and (II); and on the developer carrying member, the developer being in a coat weight not more than 1.5 mg/cm$^2$ at the developing zone after its regulation by the regulation member.

According to the present invention constituted as described above, the smeared images can be prevented even when the talc contained in transfer materials, which is the main cause of smeared images, stands adhered to the photosensitive-drum surface. This is attributable to the photosensitive drum surface layer formed of a material, which is a blend of a low-molecular-weight polycarbonate resin, and a high-molecular-weight polycarbonate resin and also to the toner coated on the developing sleeve in a small quantity, so that the photosensitive drum surface can be abraded with ease and the talc can be scraped off by a cleaning blade together with the photosensitive drum surface.

In the present invention constituted as described above, a fine powder, in particular, an inorganic fine powder may further be added externally to the toner. Particles of the fine powder externally added act as an abrasive and make the photosensitive drum surface abradable with greater ease, bringing about a great effect to prevent smeared images. This also contributes to the prevention of a phenomenon where the toner melts adheres to the photosensitive drum surface in its circumferential direction (i.e., filming) and a phenomenon where the external additive slips through a cleaning blade to cause faulty cleaning.

DESCRIPTION OF THE PREFERRED EMBODIMENTS

Figure 1:
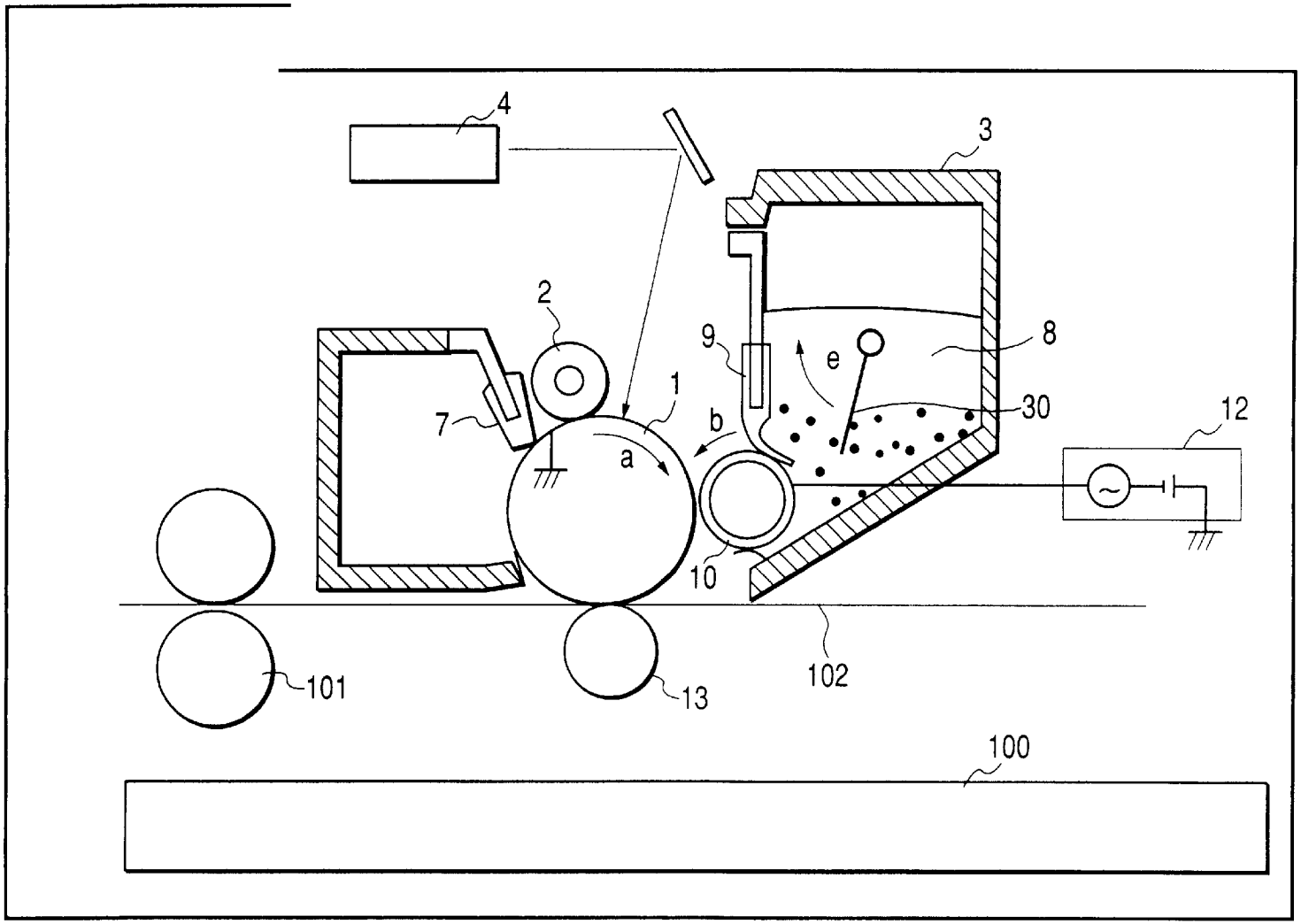
FIG. 1 is a sectional side elevation of an image forming apparatus according to the present invention.

FIG. 1 schematically illustrates the construction of an example of a laser-beam printer employing an electrophotographic process to which the present invention is applied. FIG. 1 has been referred to in the description of the prior art. This drawing is also used here since the image forming process itself is the same as the conventional one.

Reference numeral 1 denotes an electrophotographic photosensitive member, e.g., a photosensitive drum, which is formed of an OPC photosensitive member. The photosensitive drum is driven at a rotational speed, i.e., a process speed of 100 mm/sec, and is rotated in the direction of an arrow a. The surface of the photosensitive drum 1 is uniformly electrostatically charged by the aid of a charging roller 2. Next, it is exposed by means of a laser scanner 4 in accordance with image signals. The laser scanner 4 is so driven that a polygon scanner scans the drum surface with on-and-off light of a semiconductor laser to form an image on the photosensitive drum 1 though an optical system. Thus, an electrostatic latent image is formed. The electrostatic latent image thus formed, is developed with a toner that is kept in a developing container 3 and then carried on a developing sleeve 10 and transported to the developing zone. It is developed by a developing method, such as jumping development, where imagewise exposure in which the laser is lighted to eliminate electric charges at the areas to be recorded, and reversal development in which the toner is caused to adhere to areas having fewer electric charges, are used in combination.

The image (toner image) formed by development is transferred onto a transfer material 102. Transfer materials 102 are held in a cassette 100, and are fed, sheet by sheet, through a paper feed roller (not shown). Printing signals are sent from a host, whereupon the paper is fed through the paper feed roller, and the toner image is transferred to the transfer material paper by means of a transfer roller 13. The transfer roller 13 is a conductive elastic member. At a nip formed between the photosensitive drum 1 and the transfer roller 13, the toner image is transferred electrostatically by the aid of a bias electric field.

The transfer material 102 to which the toner image has been transferred is forwarded to a fixing assembly 101, where the toner image is fixed. Meanwhile, the toner remaining after transfer is removed by a cleaning blade 7, thus the cleaning drum surface.

On the developing sleeve 10, the toner is regulated by a doctor blade (developer layer thickness regulation member) 9 and is made into a thin layer with a toner coat weight not more than 1.5 mg/cm$^2$ at the developing zone so that electric charges can surely and stably be imparted to the toner between the developing sleeve 10 and the doctor blade 9, the unstable toner remaining after transfer can be in a small quantity, and the toner acting also as a lubricant at the part with which the cleaning blade 7 is brought into touch, can be in a small quantity. Thus, the photosensitive-drum surface can be abraded with ease and the talc can be scraped off together with the photosensitive drum surface to prevent smeared images.

Figure 2:
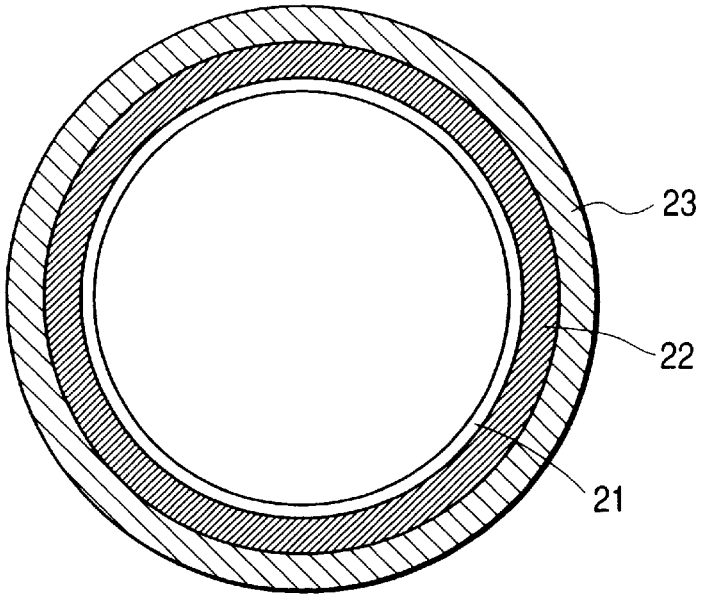
FIG. 2 is a cross-sectional view of a photosensitive drum according to the present invention.

FIG. 2 is a detailed illustration of a cross section of the photosensitive drum 1 used in the present invention.

The photosensitive drum 1 comprises a substrate 21, a charge generation layer 22 and a charge transport layer 23.

As the substrate 21, usable are cylindrical tubes made of a metal (such as aluminum or stainless steel), paper or plastics, and endless films.

The charge generation layer 22 is formed by coating on the substrate a dispersion prepared by well dispersing a charge-generating pigment in a 0.5- to 4-fold amount of a binder resin and a solvent used together, by a dispersion means such as a homogenizer, ultrasonic waves, a ball mill, a vibrating ball mill, a sand mill, an attritor or a roll mill, followed by drying. It may be formed in a thickness of from about 0.1 to about 1 $\mu$m.

The charge-transport layer 23 is formed by coating on the charge-generation layer a solution prepared by dissolving in a solvent a charge-transporting material and a blend composition of polycarbonate resins (I) and (II) detailed later. The charge-transporting material and the polycarbonate-resin-blend composition may be mixed in a proportion of from about 2:1 to about 1:2. As the solvent, usable are ketones such as cyclohexanone, esters such as methyl acetate and ethyl acetate, ethers such as THF, and chlorine type hydrocarbons such as chlorobenzene, chloroform and carbon tetrachloride.

In general, the strength (wear resistance and hardness) of resin increases with an increase in molecular weight. However, at a certain molecular weight or above, the strength no longer increases even with a further increase in molecular weight to show a constant value. On the other hand, the strength decreases little by little with a decrease in molecular weight, and also lowers abruptly at a certain molecular weight or below.

In the case of the polycarbonate resin, the molecular weight at which its strength lowers abruptly is $1.5\times10^4$ to $2.0\times10^4$. Hence, incorporating in a certain quantity a resin having a molecular weight lower than this value enables the photosensitive layer to be endowed with an appropriate wearability.

Thus, since the photosensitive layer containing such a polycarbonate resin as a low-molecular weight component has an appropriate wearability, any low-resistance deposits, such as ozone products, can readily be removed on account of microscopic wear of the photosensitive member surface and its surface can be kept clean to hardly cause image deterioration. On the other hand, a surface not incorporated with the low-molecular weight component has tendency of being weak to a mechanical external force, such as wear, and, as a result of repetition of image formation, comes to have areas that wear in a large quantity and areas that wear only in a small quantity. As the result, in some cases, the low-resistance deposits are not completely removed at the areas that wear only in a small quantity, tending to act a little disadvantageously for the smeared images.

In the present invention, a blend composition of at least one polycarbonate resin (I) having a viscosity-average molecular weight not more than $1.5\times10^4$ and at least one polycarbonate resin (II) having a viscosity-average molecular weight more than $1.5\times10^4$ is used. With regard to its compositional proportion, the polycarbonate resin (I) having a viscosity-average molecular weight not more than $1.5\times10^4$ may preferably be contained in a proportion of from 30% by weight to 95% by weight based on the weight of the blend composition.

If the polycarbonate resins (I) is less than 30% by weight, the photosensitive layer can not be endowed with an appropriate wearability, making it impossible to bring about the effect stated above. If, on the other hand, it is more than 95% by weight, there are problems of excessive wearability and a decrease in viscosity. Also, the polycarbonate resin (I) is required to have a molecular weight of not more than $1.5\times10^4$ at which an abrupt change in strength occurs, as stated above.

The viscosity-average molecular weight of the polycarbonate resin is measured in the following way. A sample weighed precisely in an amount of 0.5 g is dissolved in 100 ml of methylene chloride. The solution obtained is put to measurement of its specific viscosity at 25° C. by means of an Ubbellohde viscometer. Intrinsic viscosity is found from the specific viscosity thus measured, and the viscosity-average molecular weight is calculated according to the Mark-Houwink's viscosity equation.

The polycarbonate resin (I) may preferably have a viscosity-average molecular weight not more than $1\times10^4$, and particularly preferably in the range of from $4\times10^3$ to $1\times10^4$. The polycarbonate resin (II) may particularly preferably have a viscosity-average molecular weight not more than $8\times10^4$.

The polycarbonate resin used in the present invention may preferably be a polycarbonate resin containing a linear polymer composed of at least one repeating unit represented by the following Formula (A).

Formula (A)

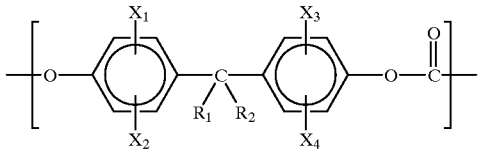

wherein $R_1$ and $R_2$ each represent a hydrogen atom, an alkyl group or an aromatic group; $R_1$ and $R_2$ may combine to form a cyclic structure together with the carbon atom to which they are bonded; and $X_1$, $X_2$, $X_3$ and $X_4$ each represent a hydrogen atom, a halogen atom, an alkyl group or an aryl group.

The charge-transporting material may include triallylamine compounds, hydrazone compounds, stilbene compounds, pyrazoline compounds, oxazole compounds, triarylmethane compounds and thiazole compounds.

Figure 3:
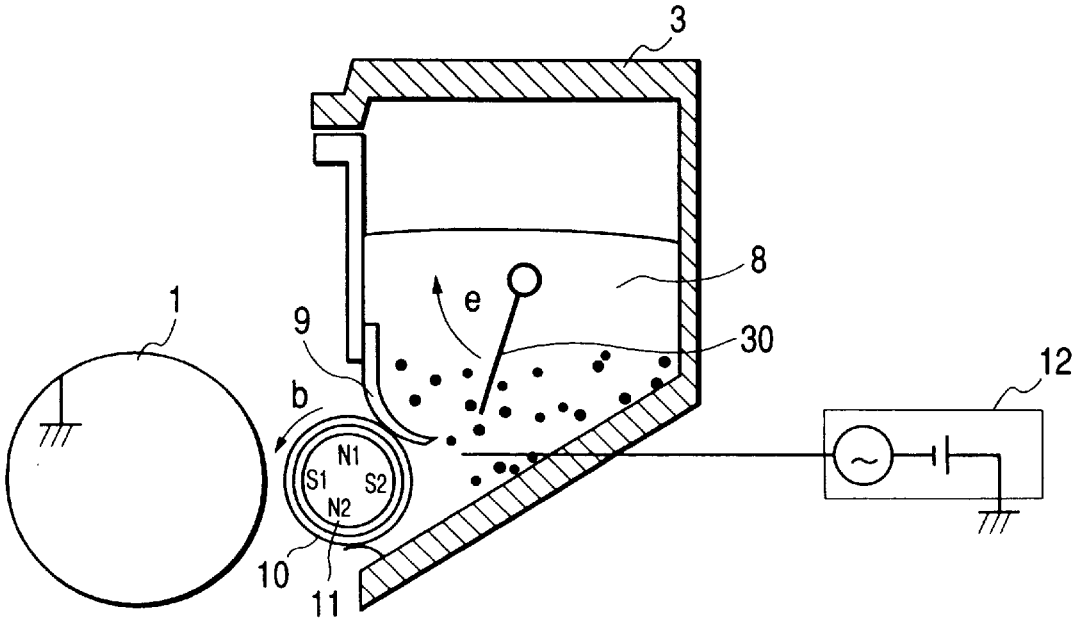
FIG. 3 is a sectional side elevation of a developing apparatus according to the present invention.

An example of a developing apparatus for which the toner on the developing sleeve is in a coat weight not more than 1.5 mg/cm$^2$ at the developing zone is cross-sectionaly illustrated in FIG. 3.

A doctor blade 9 made of an elastic material, which is a developer regulation member, is brought into touch with a developing sleeve 10. The developing sleeve 10 is a non-magnetic aluminum sleeve of 16 mm in diameter, and is a sleeve having a surface roughness Ra of 1.0 $\mu$m, surface-coated with a resin containing conductive particles.

The doctor blade 9 comprises a silicone rubber having a rubber hardness of 40° in JIS A, which is set to the developing container in such a way that it comes into touch with the developing sleeve 10 at a touching force (or contact pressure) P (touching load per 1 cm in the sleeve lengthwise direction) of 35 gf/cm. The touching width (nip) between the developing sleeve 10 and the doctor blade 9 is set at 1.0 mm. The distance from the touching uppermost-stream position (upstream in the rotational direction of the developing sleeve 10) to the free end of the doctor blade 9 is set at 1.7 mm.

A magnet roll 11 is stationarily disposed inside the developing sleeve 10. A negatively chargeable, one-component magnetic toner 8 is kept in a developing container 3, and is forwarded to the vicinity of the developing sleeve 10 while being agitated. Thereafter, the toner is fed onto the developing sleeve 10 by the action of a magnetic field formed by the magnet roll 11 and is transported as the developing sleeve 10 is rotated. Then, it is triboelectrically charged and regulated in layer thickness at the part where the developing sleeve 10 comes into touch with the doctor blade 9, and is transported to the developing zone.

To the developing sleeve 10, an alternating voltage (development bias) formed by superimposing an AC voltage on a DC voltage is applied from a power source 12 to form a development electric field across the sleeve and a photosensitive drum 1. The development of the electrostatic latent image is carried out in accordance with the electric field. A development bias formed by superimposing an AC voltage (rectangular wave; Vpp: 1,600 V; f (frequency): 1,800 Hz) on a DC voltage (Vdc: −500 V) is applied to the developing sleeve 10. The developing sleeve 10 and the photosensitive drum 1 face each other, leaving a gap of 300 $\mu$m at the closest position between them. The photosensitive drum 1 is uniformly electrostatically charged to a charge potential Vd (dark-area potential) of −700 V, and is exposed to laser light in accordance with image signals to form exposed areas having a Vl (light-area potential) of −150 V. The Vl areas are reverse-developed with the negatively chargeable toner.

In order to make the photosensitive drum surface abradable with ease and achieve the prevention of smeared images more effectively, it is effective to externally add to the toner, fine-powder particles which act as an abrasive as a developer component.

Such external-additive fine-powder particles, in particular, metal oxide particles have a very higher hardness than the toner particles 8. Hence, the metal oxide particles act as an abrasive at the part where the cleaning blade 7 comes into touch with the photosensitive drum 1, and make the surface of the photosensitive drum 1 abradable with ease.

As the metal oxide particles, strontium titanate is a strongly positively chargeable substance and hence, in a reverse-development-type image forming apparatus, tends to participate in development at the area corresponding to the white background. Especially when the toner 8 on the developing sleeve 10 is made into a thin layer with a coat weight not more than 1.5 mg/cm$^2$, the toner 8 is surely triboelectrically charged at the part where the developing sleeve 10 comes into touch with the doctor blade 9, and hence the strontium titanate comes to have a high positive-charge quantity to have a greater developing power at the white background area.

To the white background area, only a reverse-developing toner stands adhered in a small quantity, and hence the talc may adhere directly to the photosensitive drum surface in a larger quantity at the white background area than at the print areas, tending to cause smeared images. Accordingly, the strongly positively chargeable material as in the present embodiment is used so that the talc having participated in development at the white background area and having adhered to the photosensitive drum surface can be scraped off to prevent smeared images. Also, since printed images are usually characters in many cases, the white background has a predominantly large area in a sheet of the transfer material 102. The positively chargeable material participates in development at the white background area and makes the photosensitive drum surface abradable with ease, thus the photosensitive drum surface can uniformly be abraded and no uneven images may also occur.

In the case of negatively chargeable toners, the toner is fast negatively charged upon its contact with the above positively chargeable fine-powder particles, and also becomes stable. Hence its developing performance is improved and its density of images can be stable. There is such an additional effect.

Other positively chargeable material, zinc oxide or the like, can also bring about the same effect as the above.

If the fine-powder particles have too small a particle diameter, any fine-powder particles having adhered to the photosensitive drum surface after transfer may slip through the cleaning blade 7 without being taken off with it, tending to cause faulty cleaning where thin vertical lines appear on white-background images. To prevent such faulty cleaning from occurring and also prevent the smeared images, the fine-powder particles may preferably have a particle diameter of from $5\times10^{-3}$ $\mu$m to 3 $\mu$m.

The particle diameter of the fine-powder particles refers to a number-average particle diameter measured on a photograph taken with an electron microscope, where 100 to 200 particles are picked up at random and their lengths are measured with a measuring instrument, such as a vernier caliper and then averaged.

It has also been found that, if the fine-powder particles are contained in too large a quantity, a phenomenon called "filming" may occur in which the toner melt-adheres to the photosensitive drum 1 in its circumferential direction. Such fine-powder particles contained in a large quantity may agglomerate to scratch the photosensitive drum surface and the toner may necessarily adhere to the scratched surface. As a result of studies, it has been found that the fine-powder particles may be contained in an amount of from 0.1% by weight to 5.0% by weight in order to prevent such filming and also satisfy the prevention of smeared images.

As preferred fine-powder particles, usable are silica, strontium titanate, cerium oxide, aluminum oxide and zinc oxide particles.

The toner 8 may preferably have an MI of from 3 to 30 and a weight-average particle diameter in the range of from 3.5 $\mu$m to 7.0 $\mu$m.

The MI stands for melt index, and is measured with an apparatus described in JIS K7210 for a method of testing flow properties of thermoplastics in Japanese Industrial Standards. It is measured by manual cutting under the following measuring conditions. Here, measured values are calculated as 10-minute values.

Measurement temperature: 125° C.

Load: 10 kg

Fill of sample: 5 to 10 g

The present invention will be described below in greater detail by giving Examples.

EXAMPLE 1

(Photosensitive drum)

The photosensitive drum 1 shown in FIG. 2 was used. The substrate 21 is an aluminum cylinder of 30 mm in diameter.

The charge generation layer 22 was formed in the following way: A dispersion comprised of 4 parts by weight of oxytitanium phthalocyanine as a charge generating pigment, 2 parts by weight of polyvinyl butyral (trade name: S-LEC BM$^2$; available from Sekisui Chemical Co., Ltd.) and 60 parts by weight of cyclohexanone was coated on the surface of the aluminum cylinder by dip coating, followed by drying to form a charge generation layer with a thickness of 0.3 $\mu$m.

The charge-transport layer 23 was formed in the following way: A coating solution comprised of 9 parts by weight of an amine compound represented by the following structural formula:

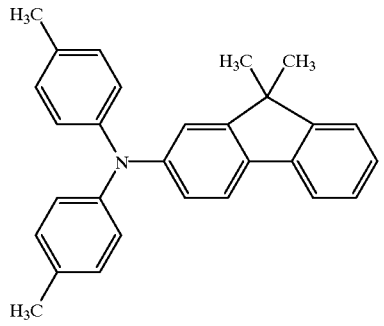

as a charge-transporting material, 9.5 parts by weight of polycarbonate resin, 2 parts by weight of polytetrafluoroethylene (trade name: LUBRON L-2; available from Daikin Industries, Ltd.; particle diameter: 0.5 μm), 50 parts by weight of monochlorobenzene and 50 parts by weight of dichloromethane was coated on the charge generation layer by dip coating, followed by drying to form a charge transport layer with a thickness of 20 μm.

As the polycarbonate resin, the following two types were used.

Polycarbonate resin (I):

The resin represented by Formula (A) and wherein $X_1$ is $CH_3$, $X_2$ is H, $X_3$ is $CH_3$, $X_4$ is H, $R_1$ is $CH_3$ and $R_2$ is $CH_3$, having a viscosity-average molecular weight of $5\times10^4$.

Polycarbonate resin (II):

The resin represented by Formula (A) and wherein $X_1$ is $CH_3$, $X_2$ is H, $X_3$ is $CH_3$, $X_4$ is H, $R_1$ is $CH_3$ and $R_2$ is $CH_3$, having a viscosity-average molecular weight of $2\times10^4$.

The polycarbonate resin (I) was present in a content of 40 parts by weight based on 100 parts by weight of the total weight of the polycarbonate resins (I) and (II), i.e., 40% by weight.

(Developer)

A negatively chargeable magnetic one-component developer was used as the toner 8. In 100 parts by weight of a styrene/n-butyl acrylate copolymer as a binder resin, 80 parts by weight of magnetic particles, 2 parts by weight of a monoazo iron complex negative charge control agent and 3 parts by weight of low-molecular weight polypropylene as a wax were melt kneaded by means of a twin-screw extruder heated to 140° C. The extruded product obtained was cooled and then crushed with a hammer mill. The crushed product obtained was finely pulverized using a jet mill. The finely pulverized product obtained was air-classified to obtain a classified powder with a weight-average particle diameter of 5.0 μm. In this classified product with a weight-average particle diameter of 5.0 μm, 1.0 part by weight of hydrophobic fine silica powder was mixed by means of a mixer having a high-speed agitator (HENSCHELL MIXER, trademark; manufactured by Mitsui Miike Engineering Corporation) to obtain a developer. Its MI (melt index), an index of fixing performance, was 20.

(Doctor blade)

The doctor blade 9 was produced in the following way: In a mold heated previously, a 60 μm thick stainless steel sheet coated with a silicone primer was placed, and LTV silicone rubber (trade name: LSR SE6744; available from Toray-Dow Corning, Inc.) was injected into the mold by means of an LIM injection molding machine. After leaving for 5 minutes at 150° C., the molded product was taken out of the mold, and then heated for 4 hours at 200° C. so as to be integrally molded. Thus, a silicone rubber blade having a rubber hardness of 40° was obtained.

Using the photosensitive drum, the developer and the doctor blade described above and using the image forming apparatus shown in FIGS. 1 and 3, images were formed in an environment of high temperature and high humidity (30° C., 80% RH) to make an evaluation on smeared images.

As transfer materials for image formation, paper containing talc was used. As an image sample used in the image formation, a pattern with a print percentage (image area percentage) of 4% was used.

Evaluation was made using the photosensitive drum of the present Example and in respect of an instance where the toner 8 on the developing sleeve 10 was in a coat weight of 2.5 mg/cm$^2$ as in conventional developing apparatus and an instance where it was in a coat weight of 1.0 mg/cm$^2$ as in the developing apparatus of the present Example according to the present invention. Evaluated in accordance with the extent to which lines appeared in character areas in each pattern of alphabets and chinese characters having a print percentage (image area percentage) of 4%. Results of evaluation made when images were formed on up to 10,000 sheets are shown in Table 1.

TABLE 1

| Coat weight | 1,000 sheets | 2,000 sheets | 3,000 sheets | 4,000 sheets | 5,000 sheets |
|---|---|---|---|---|---|
| 1.0 mg/cm$^2$: | A | A | A | A | A |
| 2.5 mg/cm$^2$: | A | A | B | B | B |
| | 6,000 sheets | 7,000 sheets | 8,000 sheets | 9,000 sheets | 10,000 sheets |
| 1.0 mg/cm$^2$: | B | B | B | B | B |
| 2.5 mg/cm$^2$: | C | C | C | C | C |

A: No smeared images occur.
B: Smeared images occur in which lines appear in letter and character areas but on a level not worrisome.
C: Smeared images occur so seriously as to cause broken line images.

A: No smeared images occur.

B: Smeared images occur in which lines appear in letter and character areas but on a level not worrisome.

C: Smeared images occur so seriously as to cause broken line images.

As shown in Table 1, when the toner 8 on the developing sleeve 10 is in a large coat weight, smeared images occur on and after printing on 3,000 sheets. The reason therefor is as follows: Since the toner on the developing sleeve 10 is in a large coat weight, the toner 8 that participates in development on the photosensitive drum 1 is in a large quantity. In this toner 8, toner having no proper electric charges is also contained in a large quantity. Hence, toner that does not move to the side of the transfer material 102 at the time of transfer and remains on the side of the photosensitive drum 1 is also in a large quantity. This much transfer residual toner comes to be pushed aside by the cleaning blade 7 in the cleaning assembly. Then, much toner intervenes at the part where the cleaning blade 7 comes into touch with the photosensitive drum 1, and part of this toner acts as a lubricant for the cleaning blade 7, so that the action to abrade the photosensitive-drum surface becomes small and the talc adheres to the photosensitive-drum surface to cause smeared images.

In the case when the toner-coat weight on the developing sleeve 10 is 2.5 mg/cm$^2$, the abrasion of the photosensitive drum surface was in a depth of 0.8 μm per 1,000 sheets.

On the other hand, in the case when the toner coat weight on the developing sleeve 10 is 1.0 mg/cm$^2$, the smeared images occur on and after printing on 6,000 sheets but on a level not problematic in practical use, and do not become worse any longer up to printing on 10,000 sheets. In this case, the abrasion of the photosensitive-drum surface was in a depth of 1.1 $\mu$m per 1,000 sheets. It has been confirmed that the toner intervenes in a smaller quantity at the part where the cleaning blade 7 comes into touch with the photosensitive drum 1 and that the photosensitive drum 1 can be abraded in a depth appropriate to the action to prevent smeared images.

In the above evaluation, also evaluated were levels at which smeared images occur on 10,000-sheet printing, with respect to the coat weight of the toner 8 on the developing sleeve 10 to obtain the results shown in Table 2.

TABLE 2

| Coat weight: (mg/cm$^2$) | | | | | |
|---|---|---|---|---|---|
| 0.8 | 1.0 | 1.2 | 1.5 | 1.7 | 2.0 |
| Smeared image level: | | | | | |
| A | B | B | B | C | C |

A: No smeared images occur.
B: Smeared images occur in which lines appear in letter and character areas but on a level not worrisome.
C: Smeared images occur so seriously as to cause broken line images.

A: No smeared images occur.

B: Smeared images occur in which lines appear in letter and character areas but on a level not worrisome.

C: Smeared images occur so seriously as to cause broken line images.

As can be seen from Table 2, it has been confirmed that, in order to keep smeared images from occurring and to be effective enough not to be problematic in practical use, the coat weight of the toner on the developing sleeve 10 is not more than 1.5 mg/cm$^2$.

Under the constitution of the present invention, running tests were also made in environments of normal temperature and normal humidity (25° C., 60% RH), low temperature and low humidity (15° C., 10% RH) and high temperature and high humidity (30° C., 80% RH). As a result, it has been confirmed that no difficulties occur under the constitution of the present invention and high-quality images can stably be obtained in all environments.

As described above, where the photosensitive drum has the photosensitive layer formed of a low-molecular-weight polycarbonate resin and a high-molecular-weight polycarbonate resin and also where the toner is regulated on the developing sleeve 10 into a thin layer having a coat weight not more than 1.5 mg/cm$^2$ at the developing zone, the photosensitive-drum surface can be abraded with ease and the talc, having adhered to the photosensitive drum surface, can be scraped off together with the photosensitive drum surface, thus preventing the production of smeared images and obtaining stable images.

EXAMPLE 2

In the present Example, fine-powder particles are externally added to the classified product for the toner used in Example 1, and the toner on the developing sleeve is in a coat weight not more than 1.5 mg/cm$^2$.

To describe this example specifically, metal oxide particles 2.0% by weight of strontium titanate particles having a primary particle diameter of 1.8 $\mu$m were added to the classified product for the toner used in Example 1, and mixed by means of a Henschel mixer so as to be externally added.

Using the toner 8 thus obtained, images were formed under the same conditions as in Example 1 except that the toner on the developing sleeve 10 was regulated only in a coat weight of 1.0 mg/cm$^2$. Evaluation was made on how smeared images occur depending on the presence or absence of the fine-powder particles strontium titanate.

Results of evaluation are shown in Table 3.

TABLE 3

| Fine-powder particles | 1,000 sheets | 2,000 sheets | 3,000 sheets | 4,000 sheets | 5,000 sheets |
|---|---|---|---|---|---|
| Present: | A | A | A | A | A |
| Absent: | A | A | A | A | A |
| | 6,000 sheets | 7,000 sheets | 8,000 sheets | 9,000 sheets | 10,000 sheets |
| Present: | A | A | A | A | A |
| Absent: | B | B | B | B | B |

A: No smeared images occur.
B: Smeared images occur in which lines appear in letter and character areas but on a level not worrisome.
C: Smeared images occur so seriously as to cause broken line images.

A: No smeared images occur.

B: Smeared images occur in which lines appear in letter and character areas but on a level not worrisome.

C: Smeared images occur so seriously as to cause broken line images.

As stated also in Example 1, where the toner 8 on the developing sleeve 10 is regulated to be in a small coat weight, the photosensitive drum surface can be abraded with ease and the smeared images can be prevented up to printing on 10,000 sheets at least at the level not problematic in practical use. Where the fine-powder particles strontium titanate was further added, the photosensitive drum surface was more and uniformly abraded and no smeared images occurred at all up to the printing on 10,000 sheets as shown in Table 3. Here, the abrasion of the photosensitive drum surface was in a depth of 1.5 $\mu$m per 1,000 sheets, whereas it was in a depth of 1.1 $\mu$m in the absence of the fine-powder particles. Thus, the photosensitive drum surface was confirmed to have been more abraded in the former than in the latter.

As shown above, under the constitution of the present invention in which the fine-powder particles are further externally added to the toner 8, the fine-powder particles externally added, act as an abrasive to make the photosensitive-drum surface abradable with ease, bringing about a great effect in preventing smeared images. The external addition of the fine-powder particles also enables prevention of both the filming and the faulty cleaning, the former being a phenomenon caused when the toner melt-adheres to the photosensitive drum surface in its circumferential direction and the latter being a phenomenon caused when the external additive slips through the cleaning blade 7.

EXAMPLE 3

The present Example concerns a process cartridge having a photosensitive drum and a developing assembly.

Figure 4:
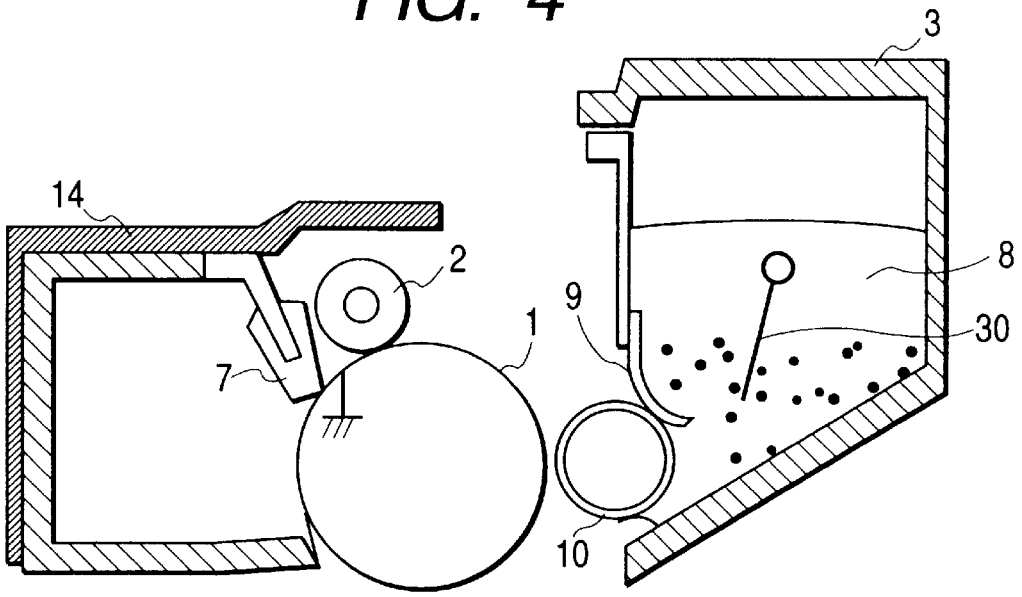
FIG. 4 is a sectional side elevation of a process cartridge according to the present invention.

FIG. 4 is a cross-sectional view of a process cartridge of the present Example.

The same photosensitive drum 1 as that used in Example 1, a charging assembly 2 for charging the surface of the photosensitive drum 1 electrostatically, a developing assembly 3 for rendering visible an electrostatic latent image formed on the surface of the photosensitive drum 1, and a cleaning assembly 14 for removing a toner 8 having remained on the photosensitive drum 1 after transfer, without being transferred to a transfer material, are set as one unit so as to be detachably mountable to the main body of an image forming apparatus. Process conditions for image formation are set like those in Example 1.

Figure 5:
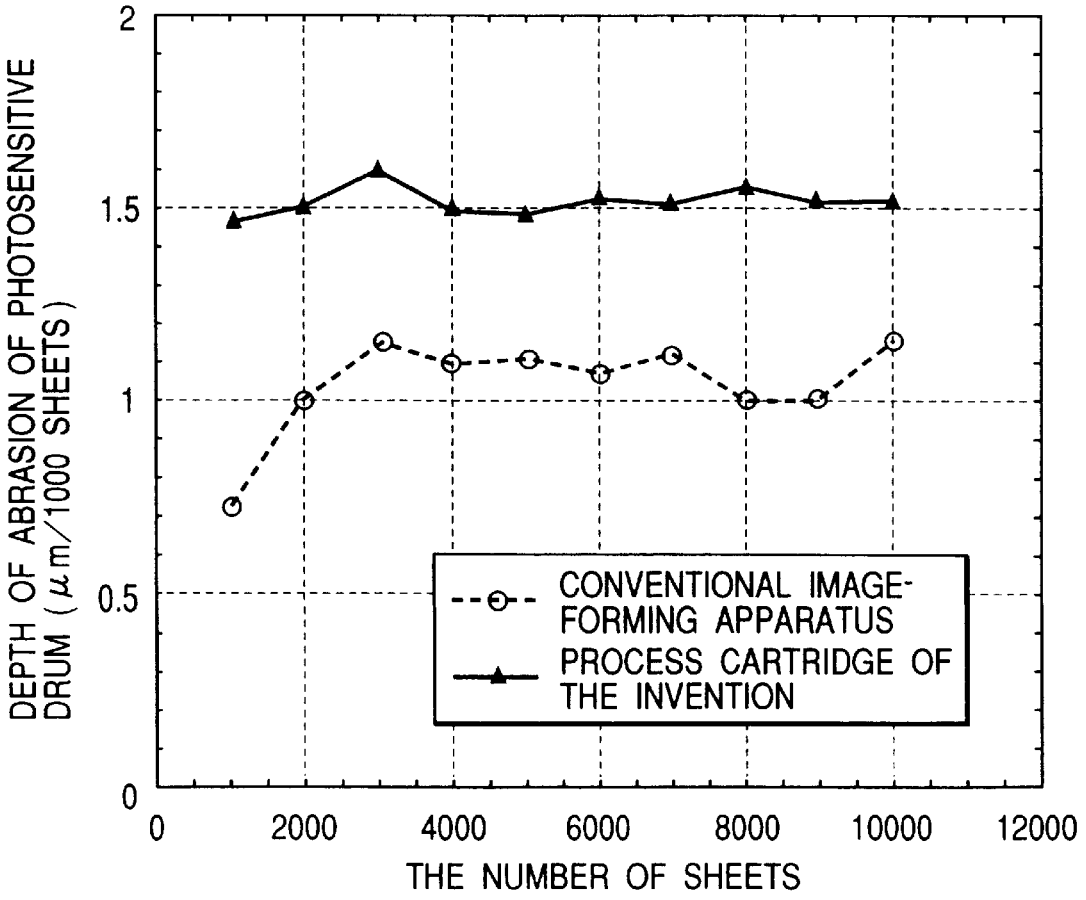
FIG. 5 is a graph showing changes in the depth of abrasion of photosensitive drum surface.

In general, because of discharge due to the charging with the charging assembly 2, the surface of the photosensitive drum 1 deteriorates to become readily abradable. On the other hand, when new, the surface of the photosensitive drum 1 is abradable with difficulty. For example, as shown by a broken line in FIG. 5, which shows changes in depth of abrasion of photosensitive drum surface at intervals of 1,000-sheet printing (a photosensitive drum produced in the same manner as in Example 1 except for using a polycarbonate resin of Formula (A) wherein $X_1$ is $CH_3$, $X_2$ is H, $X_3$ is $CH_3$, $X_4$ is H, $R_1$ is $CH_3$ and $R_2$ is $CH_3$, having a viscosity-average molecular weight of $4\times10^4$), the depth of abrasion is a little small at the initial stage and up to the printing on 1,000th sheets, and stands stable thereafter. Thus, the smeared images tend to occur at the initial stage of service where the photosensitive drum surface is abradable in a small depth.

Now, in the present invention, such a depth of abrasion of the photosensitive drum surface can be made stable by regulating the toner 8 on the developing sleeve 10 in a coat weight not more than 1.5 mg/cm$^2$ and externally adding to the toner 8 the positively chargeable material having a high hardness, as described in Example 2.

Where the toner 8 on the developing sleeve 10 is regulated into a thin layer having a coat weight not more than 1.5 mg/cm$^2$, the external additive used as an abrasive is highly triboelectrically charged to have a greater developing power, and has a tendency of participating in development in a large quantity at the initial stage of service. Hence, the photosensitive drum surface can be abraded in a large quantity correspondingly to the abrasive having adhered in a large quantity.

Figure 6:
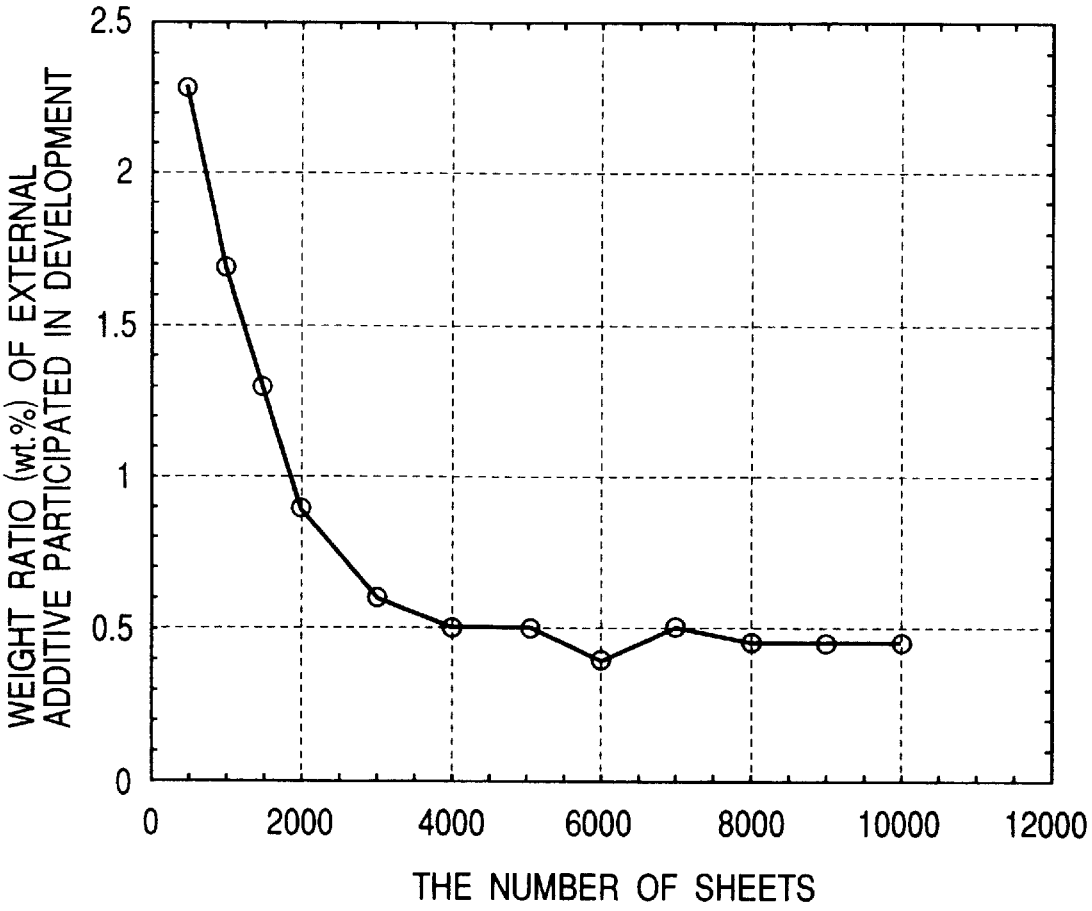
FIG. 6 is a graph showing changes in the weight ratio of an external additive consumed.

For example, in the case of the toner used in Example 2 to which strontium titanate is added, the quantity of strontium titanate, having participated in development on the photosensitive drum changes as shown in FIG. 6 at intervals of 1,000-sheet printing when images are formed at a print percentage (image area percentage) of 4%. Since the positively chargeable material such as strontium titanate tends to fly to the area corresponding to the white background, it tends to participate in development in a large quantity at the initial stage, and thereafter the strontium titanate contained in the toner becomes smaller in quantity and hence participates in development in a smaller quantity.

In this way, the abrasive is supplied in a little large quantity at the initial stage where the photosensitive drum surface is abradable with difficulty and the abrasive decreases as the photosensitive drum 1 becomes abradable with ease. Thus, the depth of abrasion of the photosensitive drum surface can be made stable.

In the present invention, the depth of abrasion of the photosensitive drum surface was ascertained using a toner 8 to which strontium titanate particles were externally added in an amount of 1.5% by weight. The results obtained are shown by a solid line in FIG. 5. The depth of abrasion of the surface of the photosensitive drum 1 was kept substantially stable throughout its service life. Evaluation was also made on smeared images to confirm that no smeared images occurred up to printing on 10,000 sheets.

In order to attain the above effect, a new photosensitive drum is required to be used in combination with a new developing assembly. Accordingly, a process cartridge in which at least the photosensitive drum and the developing assembly are set as one unit as in the present Example can be provided for users in such a form that the photosensitive drum surface is abradable in an optimum depth.

EXAMPLE 4

An evaluation test on smeared images was made in the same manner as in Example 1 except that the polycarbonate resins (I) and (II) used therein were replaced with the following.

Polycarbonate resin (I):

The resin represented by Formula (A) and wherein $X_1$ is H, $X_2$ is H, $X_3$ is H, $X_4$ is H, and $R_1$ and $R_2$ combine to form a cyclohexane ring together with the carbon atom to which they are bonded, having a viscosity-average molecular weight of $4\times10^3$.

Polycarbonate resin (II):

The resin represented by Formula (A) and wherein $X_1$ is H, $X_2$ is H, $X_3$ is H, $X_4$ is H, and $R_1$ and $R_2$ combine to form a cyclohexane ring together with the carbon atom to which they are bonded, having a viscosity-average molecular weight of $1.6\times10^4$.

Results of evaluation are shown in the following table (letter symbols A, B and C are as designated previously).

| Coat weight | 1,000 sheets | 2,000 sheets | 3,000 sheets | 4,000 sheets | 5,000 sheets |
|---|---|---|---|---|---|
| 1.2 mg/cm$^2$: | A | A | A | A | A |
| 2.8 mg/cm$^2$: | A | B | B | B | C |
| | 6,000 sheets | 7,000 sheets | 8,000 sheets | 9,000 sheets | 10,000 sheets |
| 1.2 mg/cm$^2$: | A | A | B | B | B |
| 2.8 mg/cm$^2$: | C | C | C | C | C |

EXAMPLE 5

An evaluation test on smeared images was made in the same manner as in Example 1 except that the polycarbonate resins (I) and (II) used therein were replaced with the following.

Polycarbonate resin (I):

The resin represented by Formula (A) and wherein $X_1$ is H, $X_2$ is H, $X_3$ is H, $X_4$ is H, $R_1$ is $CH_3$ and $R_2$ is $C_6H_6$, having a viscosity-average molecular weight of $1\times10^4$.

Polycarbonate resin (II):

The resin represented by Formula (A) and wherein $X_1$ is H. $X_2$ is H, $X_3$ is H, $X_4$ is H, $R_1$ is $CH_3$ and $R_2$ is $C_6H_6$, having a viscosity-average molecular weight of $8\times10^4$.

Results of evaluation are shown in the following table (letter symbols A, B and C are as designated previously).

| Coat weight | 1,000 sheets | 2,000 sheets | 3,000 sheets | 4,000 sheets | 5,000 sheets |
|---|---|---|---|---|---|
| 1.5 mg/cm$^2$: | A | A | A | A | A |
| 2.3 mg/cm$^2$: | A | A | B | B | B |
| | 6,000 sheets | 7,000 sheets | 8,000 sheets | 9,000 sheets | 10,000 sheets |
| 1.5 mg/cm$^2$: | A | B | B | B | B |
| 2.3 mg/cm$^2$: | B | C | C | C | C |

EXAMPLE 6

An evaluation test on smeared images was made in the same manner as in Example 1 except that the polycarbonate resins (I) and (II) used therein were replaced with the following and the polycarbonate resins (I) and (II) were mixed in a proportion of 30% by weight and 70% by weight.

Polycarbonate resin (I):

The resin represented by Formula (A) and wherein $X_1$ is H, $X_2$ is H, $X_3$ is H, $X_4$ is H, $R_1$ is $CH_3$ and $R_2$ is $CH_3$, having a viscosity-average molecular weight of $7\times10^3$.

Polycarbonate resin (II):

The resin represented by Formula (A) and wherein $X_1$ is H, $X_2$ is H, $X_3$ is H, $X_4$ is H, $R_1$ is $CH_3$ and $R_2$ is $CH_3$, having a viscosity-average molecular weight of $2\times10^4$.

Results of evaluation are shown in the following table (letter symbols A, B and C are as designated previously).

| Coat weight | 1,000 sheets | 2,000 sheets | 3,000 sheets | 4,000 sheets | 5,000 sheets |
|---|---|---|---|---|---|
| 0.9 mg/cm$^2$: | A | A | A | A | A |
| 2.5 mg/cm$^2$: | A | A | B | B | B |
| | 6,000 sheets | 7,000 sheets | 8,000 sheets | 9,000 sheets | 10,000 sheets |
| 0.9 mg/cm$^2$: | A | A | B | B | B |
| 2.5 mg/cm$^2$: | C | C | C | C | C |

EXAMPLE 7

An evaluation test on smeared images was made in the same manner as in Example 1 except that the polycarbonate resins (I) and (II) used therein were replaced with the following.

Polycarbonate resin (I):

The resin represented by Formula (A) and wherein $X_1$ is $CH_3$, $X_2$ is H, $X_3$ is $CH_3$, $X_4$ is H, $R_1$ is $CH_3$ and $R_2$ is $CH_3$, having a viscosity-average molecular weight of $5\times10^3$.

Polycarbonate resin (II):

The resin represented by Formula (A) and wherein $X_1$ is H, $X_2$ is H, $X_3$ is H, $X_4$ is H, and $R_1$ and $R_2$ combine to form a cyclohexane ring together with the carbon atom to which they are bonded, having a viscosity-average molecular weight of $2\times10^4$.

Results of evaluation are shown in the following table (letter symbols A, B and C are as designated previously).

| Coat weight | 1,000 sheets | 2,000 sheets | 3,000 sheets | 4,000 sheets | 5,000 sheets |
|---|---|---|---|---|---|
| 1.2 mg/cm$^2$: | A | A | A | A | A |
| 2.0 mg/cm$^2$: | A | A | A | B | B |
| | 6,000 sheets | 7,000 sheets | 8,000 sheets | 9,000 sheets | 10,000 sheets |
| 1.2 mg/cm$^2$: | A | B | B | B | B |
| 2.0 mg/cm$^2$: | B | B | C | C | C |

EXAMPLE 8

An evaluation test on smeared images was made in the same manner as in Example 1 except that the polycarbonate resins (I) and (II) used therein were replaced with the following and the polycarbonate resin (I) was used in a proportion of 60% by weight.

Polycarbonate resin (I):

The resin represented by Formula (A) and wherein $X_1$ is H, $X_2$ is H, $X_3$ is H, $X_4$ is H, and $R_1$ and $R_2$ combine to form a cyclohexane ring together with the carbon atom to which they are bonded, having a viscosity-average molecular weight of $8\times10^3$.

Polycarbonate resin (II):

The resin represented by Formula (A) and wherein $X_1$ is H, $X_2$ is H, $X_3$ is H, $X_4$ is H, and $R_1$ and $R_2$ combine to form a cyclohexane ring together with the carbon atom to which they are bonded, having a viscosity-average molecular weight of $4\times10^4$.

Results of evaluation are shown in the following table (letter symbols A, B and C are as designated previously).

| Coat weight | 1,000 sheets | 2,000 sheets | 3,000 sheets | 4,000 sheets | 5,000 sheets |
|---|---|---|---|---|---|
| 1.0 mg/cm$^2$: | A | A | A | A | A |
| 2.5 mg/cm$^2$: | A | A | B | B | B |
| | 6,000 sheets | 7,000 sheets | 8,000 sheets | 9,000 sheets | 10,000 sheets |
| 1.0 mg/cm$^2$: | A | A | A | B | B |
| 2.5 mg/cm$^2$: | C | C | C | C | C |

What is claimed is:

1. An image forming apparatus comprising an image bearing member, a developer carrying member for carrying thereon a developer to transport the developer to a developing zone, and a regulation member provided in touch with the surface of the developer carrying member to regulate the coat weight of the developer carried thereon, said developer carrying member carrying and transporting the developer to the developing zone, and an electrostatic latent image formed on said image bearing member being developed and rendered visible while applying a development bias to said developer carrying member, wherein wherein said image bearing member comprises a conductive substrate and a photosensitive layer formed thereon, and the photosensitive layer contains at least one polycarbonate resin (I) having a viscosity-average molecular weight not more than $1.5\times10^4$ and at least one polycarbonate resin (II) having a viscosity-average molecular weight more than $1.5\times10^4$, the polycarbonate resin (I) being contained in a proportion of from 30% by weight to 95% by weight based on the total weight of the polycarbonate resins (I) and (II), wherein on said developer carrying member, the developer has a coat weight not more than 1.5 mg/cm$^2$ at the developing zone after its regulation by said regulation member.

2. The image forming apparatus according to claim 1, wherein at least one fine-powder particles are externally added to the developer, which have a number-average particle diameter of from $5\times10^{-3}$ $\mu$m to 3 $\mu$m and are externally added in an amount of from 0.1% by weight to 5.0% by weight.

3. The image forming apparatus according to claim 2, wherein said at least one fine-powder particles are chargeable to a polarity reverse to that of the developer.

4. The image forming apparatus according to claim 2 or 3, wherein said at least one fine-powder particles are inorganic fine-powder particles.

5. The image forming apparatus according to claim 2 or 3, wherein said at least one fine-powder particles are metal oxide particles.

6. The image forming apparatus according to claim 1, wherein said polycarbonate resin (I) has a viscosity-average molecular weight not more than $1\times10^4$.

7. The image forming apparatus according to claim 1, wherein said polycarbonate resin (I) has a viscosity-average molecular weight of from $4\times10^3$ to $1\times10^4$ and said polycarbonate resin (II) has a viscosity-average molecular weight not more than $8\times10^4$.

8. The image forming apparatus according to claim 5, wherein said metal oxide particles comprise titanium strontium.

9. A process cartridge comprising an image bearing member, a developer carrying member for carrying thereon a developer to transport the developer to a developing zone, and a regulation member provided in touch with the surface of the developer carrying member to regulate the coat weight of the developer carried thereon, said developer carrying member carrying and transporting the developer to the developing zone, and a means for developing and rendering visible an electrostatic latent image on said image bearing member while applying a development bias to said developer carrying member being set as one unit together with the above members so as to be detachably mountable to a main body of an image forming apparatus, wherein said image bearing member comprises a conductive substrate and a photosensitive layer formed thereon, and the photosensitive layer contains at least one polycarbonate resin (I) having a viscosity-average molecular weight not more than $1.5\times10^4$ and at least one polycarbonate resin (II) having a viscosity-average molecular weight more than $1.5\times10^4$, the polycarbonate resin (I) being contained in a proportion of from 30% by weight to 95% by weight based on the total weight of the polycarbonate resins (I) and (II), wherein on said developer carrying member, the developer has a coat weight not more than 1.5 mg/cm$^2$ at the developing zone after its regulation by said regulation member.

10. The process cartridge according to claim 9, wherein at least one fine-powder particles are externally added to the developer, which have a number-average particle diameter of from $5\times10^{-3}$ $\mu$m to 3 $\mu$m and are externally added in an amount of from 0.1% by weight to 5.0% by weight.

11. The process cartridge according to claim 7, wherein said at least one fine-powder particles are chargeable to a polarity reverse to that of the developer.

12. The process cartridge according to claim 10 or 11, wherein said at least one fine-powder particles are inorganic fine-powder particles.

13. The process cartridge according to claim 10 or 11, wherein said at least one fine-powder particles are metal oxide particles.

* * * * *

UNITED STATES PATENT AND TRADEMARK OFFICE

CERTIFICATE OF CORRECTION

PATENT NO. : 6,169,869 B1
DATED : January 2, 2001
INVENTOR(S) : Satoru Inami, et al.

It is certified that error appears in the above-identified patent and that said Letters Patent is hereby corrected as shown below:

Column 2,
Line 14, "conventional a" should read -- a conventional --.

Column 3,
Line 52, "melts adheres" should read -- melts and adheres --.

Column 4,
Line 49, "the cleaning" should read -- cleaning the --.

Column 5,
Line 63, "resins" should read -- resin --.

Column 7,
Line 31, "very" should read -- much --.
Line 66, "fast" should read -- quickly --.

Column 11,
Lines 29-33 should be deleted.

Column 12,
Line 9, "fine-powder particles strontium titanate." should read -- strontium titanate fine-powder particles. --.
Lines 29-33 should be deleted.
Line 39, "fine powder particles strontium" should read -- strontium titanate fine-powder particles --.
Line 40, "titanate was" should read -- were --.

Column 16,
Line 64, "member, wherein" should read -- member, --.

UNITED STATES PATENT AND TRADEMARK OFFICE

CERTIFICATE OF CORRECTION

PATENT NO. : 6,169,869 B1
DATED : January 2, 2001
INVENTOR(S) : Satoru Inami, et al.

It is certified that error appears in the above-identified patent and that said Letters Patent is hereby corrected as shown below:

Column 17,
Lines 13, 19, 22, and 25, "one" should be deleted.

Column 18,
Lines 26, 31, 34, and 37, "one" should be deleted.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*